US008389917B2

(12) United States Patent
Jeong

(10) Patent No.: US 8,389,917 B2
(45) Date of Patent: Mar. 5, 2013

(54) WALL-MOUNTED MICROWAVE OVEN AND HOOD

(75) Inventor: Sang Jin Jeong, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1348 days.

(21) Appl. No.: 12/078,793

(22) Filed: Apr. 4, 2008

(65) Prior Publication Data

US 2008/0264933 A1 Oct. 30, 2008

(30) Foreign Application Priority Data

Apr. 25, 2007 (KR) ..... 10-2007-0040129

(51) Int. Cl.
*H05B 6/64* (2006.01)

(52) U.S. Cl. ..... 219/757; 126/21 A; 126/273 A

(58) Field of Classification Search ..... 219/757, 219/756, 702, 758, 681, 391, 400; 126/21 A, 126/21 R, 299 D, 299 R, 273 A
See application file for complete search history.

(56) References Cited

U.S. PATENT DOCUMENTS

| | | | |
|---|---|---|---|
| 6,659,292 | B2 | 12/2003 | Gough et al. |
| 6,717,123 | B1 | 4/2004 | Kim |
| 2004/0016754 | A1 * | 1/2004 | Yang ..... 219/757 |

FOREIGN PATENT DOCUMENTS

| | | | |
|---|---|---|---|
| CN | 1459589 | A | 12/2003 |
| CN | 1482396 | A | 3/2004 |
| CN | 1506619 | A | 6/2004 |
| KR | 10-0573889 | | 4/2006 |

OTHER PUBLICATIONS

Canadian Office Action dated Jun. 7, 2011 issued in Canadian Patent Application No. 2,629,854.
Chinese Office Action for corresponding Chinese Patent Application No. 2008100870771 dated Oct. 30, 2009 (5 pgs).

* cited by examiner

*Primary Examiner* — Quang Van
(74) *Attorney, Agent, or Firm* — Staas & Halsey LLP

(57) ABSTRACT

A wall-mounted microwave oven including a hood mover having a forwardly-movable hood plate. The hood plate, which guides fumes, exhaust gas, etc. to an inlet arranged at the bottom of the wall-mounted microwave oven, is separable from a body of the wall-mounted microwave oven. The hood plate is arranged outside and beneath the body, to prevent oil and dirt, etc. from being attached to a lower case of the body. The wall-mounted microwave oven includes a hood mover movable with respect to the body. The hood mover includes a hood plate, a frame member to separably support the hood plate, and a moving member to move the frame member with respect to the body. The frame member has a channel-shaped guide groove to receive the hood plate, thereby enabling the frame member to support the hood plate, and a fastener to prevent a separation of the hood plate.

8 Claims, 19 Drawing Sheets

WALL-MOUNTED MICROWAVE OVEN AND HOOD

CROSS-REFERENCE TO RELATED APPLICATIONS

This application claims the benefit of Korean Patent Application No. 10-2007-0040129, filed on Apr. 25, 2007 in the Korean Intellectual Property Office, the disclosure of which is incorporated herein by reference.

BACKGROUND

1. Field

The present invention relates to a wall-mounted microwave oven, and, more particularly, to a wall-mounted microwave oven including a hood mover having a forwardly-movable hood plate.

2. Description of the Related Art

A wall-mounted microwave oven is a cooking appliance installed over another cooking appliance such as a gas range or a cooktop installed on a counter in a kitchen, to perform a hood function for discharging, to the outdoors, exhaust gas, fumes, or food smells emitted during a cooking operation of the another cooking appliance, in addition to a cooking function using microwaves, as in general microwave ovens.

In such a wall-mounted microwave oven, microwaves emitted from a magnetron are irradiated to food to repeatedly change the arrangement of water molecules in the food, thereby causing the food to be cooked by inter-frictional heat of the water molecules. An inlet is provided at the bottom of the wall-mounted microwave oven, to suck exhaust gas, etc. An exhaust passage, in which an exhaust fan is arranged, is defined in the interior of the wall-mounted microwave oven, to discharge exhaust gas and food smells generated during a cooking operation of another cooking appliance arranged beneath the wall-mounted microwave oven, to the outdoors, through an outlet.

Generally, the cooking appliance arranged beneath the wall-mounted microwave oven has a forward width larger than that of the wall-mounted microwave oven. For this reason, it is difficult for the wall-mounted microwave oven to completely suck all of the exhaust gas, fumes, and food smell generated at the front portion of the cooking appliance.

In order to solve this problem and to enhance the hood function, a hood mover is installed at the bottom of the wall-mounted microwave oven such that the hood mover is forwardly movable. The hood mover is mounted to the wall-mounted microwave oven, in order to enable a hood plate to be manually movable with respect to a body of the wall-mounted microwave oven, or to be automatically movable with respect to the body, using a driving motor and operating gears, and thus to enable the hood plate to guide exhaust gas, etc. emitted at a front portion of another cooking appliance arranged beneath the wall-mounted microwave oven to be guided to an inlet arranged at the bottom of the wall-mounted microwave oven.

An example of a conventional wall-mounted microwave oven, in which a moving hood is coupled to a fixed hood such that the moving hood is manually movable in forward and backward directions, is disclosed in Korean Unexamined Patent Publication No. 10-2005-31781. The disclosed wall-mounted microwave oven includes a fixed hood arranged at the bottom of a body of the wall-mounted microwave oven such that the fixed hood communicates with an exhaust passage, a moving hood mounted to the fixed hood such that the moving hood is slidable, an exhauster for the fixed hood arranged in the exhaust passage, to discharge air introduced into the fixed hood to the outside of the body, and an exhauster for the moving hood arranged in the exhaust passage near the exhauster for the fixed hood, to discharge air introduced into the moving hood to the outside of the body.

As another conventional technique, an example of a conventional wall-mounted microwave oven, in which a moving hood is coupled to a fixed hood such that the moving hood is automatically movable, using a driving motor and operating gears, is disclosed in Korean Unexamined Patent Publication No. 10-2005-31780. The disclosed microwave oven includes an operating unit functioning to forwardly and backwardly move the moving hood along the fixed hood. The operating unit includes a drive motor and a pinion gear, which are fixed to the fixed hood, a rack gear engaged with the pinion gear, a support member fixed to the moving hood, together with the rack gear, a fixed rail fixedly mounted to the fixed hood, and a moving rail fixed to the moving hood beneath the support member, and fitted in the fixed rail.

However, the wall-mounted microwave oven disclosed in each of the above publications has difficulty in cleaning oil and dirt attached to the moving hood due to fumes, exhaust gas, and oil evaporated during a cooking operation because it is impossible to separate the moving hood from the fixed hood.

Furthermore, it is impossible to prevent oil and dirt, etc. from being attached to the lower case of the wall-mounted microwave oven because the moving hood is arranged within the body of the wall-mounted microwave oven.

In the above-mentioned automatic hood mover, the operating unit to automatically move the moving hood has a complex structure incurring an increase in manufacturing costs because the operating unit includes the drive motor and pinion gear, which are fixed to the fixed hood, the rack gear engaged with the pinion gear, etc.

SUMMARY

Accordingly, it is an aspect of the present invention to provide a wall-mounted microwave oven, in which a hood plate to guide fumes, exhaust gas, etc. to an inlet arranged at the bottom of the wall-mounted microwave oven is separable from a body of the wall-mounted microwave oven, so that the cleaning of the hood plate can be easily achieved.

Another aspect of the present invention is to provide a wall-mounted microwave oven, in which a hood plate is arranged outside and beneath a body of the wall-mounted microwave oven, to prevent oil and dirt, etc. from being attached to a lower case of the body.

Still another aspect of the present invention is to provide a wall-mounted microwave oven, in which a driving unit to automatically move a hood plate can be implemented, using a relatively simple structure.

Additional aspects and/or advantages of the present invention will be set forth in part in the description which follows and, in part, will be apparent from the description, or may be learned by practice of the invention.

The foregoing and/or other aspects of the present invention are achieved by providing a wall-mounted microwave oven comprising: a body comprising a lower case; a hood mover movable with respect to the body, wherein the hood mover comprises a hood plate, a frame member to separably support the hood plate, and a moving member to move the frame member with respect to the body.

The frame member may have a channel-shaped guide groove to receive the hood plate, thereby enabling the frame member to support the hood plate, and a fastener to prevent a separation of the hood plate.

The frame member may comprise a pair of linear frames each having one of the channel-shaped guide grooves and a stopper to prevent the hood plate from being excessively inserted into the respective guide groove. Alternatively, the frame member may comprise a 90°-rotated U-shaped frame having a channel-shaped guide groove.

The fastener may comprise a fixed flange provided at a front end of the frame member, a separation preventing member arranged in front of the fixed flange, to prevent a separation of the hood plate, and a coupler to couple the separation preventing member to the fixed flange. Alternatively, the fastener may comprise a screw hole formed at one surface of the frame member, and a screw coupled to the screw hole.

The moving member may comprise a fixed rail mounted to the body, and a moving rail movable with respect to the fixed rail. The frame member may have an extension connected to the moving rail.

The hood mover may be arranged beneath the lower case. In this case, the extension may extend upwardly from the frame member, to be connected to the moving rail. The lower case may have a guide hole, through which the extension is movable.

Alternatively, the hood mover may be arranged above the lower case. In this case, the extension may extend downwardly from the frame member, to be coupled to the moving rail. The lower case may have an opening formed at a front wall of the lower case, the hood mover being drawn through the opening.

The foregoing and/or other aspects of the present invention are also achieved by providing a wall-mounted microwave oven comprising: a body comprising a lower case; a hood mover movable with respect to the body, wherein the hood mover comprises a hood plate, a frame member to separably support the hood plate, and a moving member to move the frame member with respect to the body, wherein the hood plate has an inlet formed at a bottom portion of the hood plate, to receive exhaust gas, and an exhaust passage defined in an interior of the hood plate.

The hood plate may be completely received in the frame member, to be supported by the frame member. Alternatively, the hood plate may have a fitting portion.

Where the hood mover is arranged beneath the lower case, the hood plate may have has an outlet formed at a rear top portion of the hood plate. In this case, the lower case may have a communicating hole formed at a front end of the lower case. The outlet and the communicating hole may communicate with each other when the hood plate is positioned at a forwardly-moved position.

Where the hood mover is arranged above the lower case, the lower case may be rearwardly opened, to directly discharge exhaust gas through an exhaust passage defined in the body.

The foregoing and/or other aspects of the present invention are also achieved by providing a wall-mounted microwave oven comprising: a body comprising a lower case; a hood mover movable with respect to the body, wherein the hood mover comprises a hood plate, a frame member to separably support the hood plate, a moving member to move the frame member with respect to the body, and a driving unit to move the hood plate, using a driving force.

The moving member may comprise a fixed rail mounted to the body, and a moving rail movable with respect to the fixed rail. The frame member may have an extension connected to the moving rail. The driving unit may comprise a motor to generate a driving force, a lever to be rotated by the motor, and a connecting member to change a rotation of the lever to a linear movement. The connecting member may be coupled to the extension or to the moving rail.

The lever may have a protrusion formed at an end of the lever. The connecting member may have a slot formed to receive the protrusion. The protrusion may slide in the slot, thereby causing the rotation of the lever to be changed to a linear movement of the connecting member.

The driving unit may further comprise an input unit to input a command from a user, a controller to control a driving operation of the motor, a cam coupled to a rotating shaft of the motor such that the cam is rotated by the rotating shaft, and a switch to turn on/off in accordance with the rotation of the cam and to generate a corresponding signal. The switch may send the signal to the controller. The controller may drive the motor in response to a driving signal input from the input unit, and may stop the driving operation of the motor in response to a signal representing an operation state change of the switch between an ON state and an OFF state.

The motor is rotatable in forward and reverse directions. In this case, the cam may have a reduced radius portion extending in a predetermined angle range.

Alternatively, the motor is rotatable in one direction. In this case, the cam may have cam portions having different radiuses while extending 180°, respectively.

The foregoing and/or other aspects of the present invention are also achieved by providing a hood comprising: a hood body comprising a lower case having an inlet to suck exhaust gas; and a hood mover movable with respect to the body, wherein the hood mover comprises a hood plate, a frame member to separably support the hood plate, and a moving member to move the frame member with respect to the body.

The frame member may have a channel-shaped guide groove to receive the hood plate, thereby enabling the frame member to support the hood plate, and a fastener to prevent a separation of the hood plate.

The moving member may comprise a fixed rail mounted to the body, and a moving rail movable with respect to the fixed rail. The frame member may have an extension connected to the moving rail.

The hood mover may be arranged beneath the lower case. The extension may extend upwardly from the frame member, to be connected to the moving rail. The lower case may have a guide hole, through which the extension is movable. In this case, the hood plate may have an inlet formed at a bottom portion of the hood plate, to receive exhaust gas, an exhaust passage defined in an interior of the hood plate, and an outlet formed at a rear top portion of the hood plate. The lower case may have a communicating hole formed at a front end of the lower case. The outlet and the communicating hole may communicate with each other when the hood plate is positioned at a forwardly-moved position.

Alternatively, the hood mover may be arranged above the lower case. The extension may extend downwardly from the frame member, to be coupled to the moving rail. The lower case may have an opening formed at a front wall of the lower case, the hood mover being drawn through the opening. The hood plate may have an inlet formed at a bottom portion of the hood plate, to receive exhaust gas, and an exhaust passage defined in an interior of the hood plate, and may be rearwardly opened.

The hood mover may further comprise a driving unit to move the hood plate, using a driving force. The driving unit may comprise a motor to generate a driving force, a lever to be rotated by the motor, and a connecting member to change a rotation of the lever to a linear movement. The connecting member may be coupled to the extension or to the moving rail.

The driving unit may further comprise an input unit to input a command from a user, a controller to control a driving operation of the motor, a cam coupled to a rotating shaft of the driving motor such that the cam is rotated by the rotating shaft, and a switch to turn on/off in accordance with the rotation of the cam and to generate a corresponding signal. The switch may send the signal to the controller. The controller may drive the motor in response to a driving signal input from the input unit, and may stop the driving operation of the motor in response to a signal representing an operation state change of the switch between an ON state and an OFF state.

BRIEF DESCRIPTION OF THE DRAWINGS

These and/or other aspects and advantages of the present invention will become apparent and more readily appreciated from the following description of the embodiments, taken in conjunction with the accompanying drawings in which.

DETAILED DESCRIPTION OF THE EMBODIMENTS

Reference will now be made in detail to the embodiments of the present invention, examples of which are illustrated in the accompanying drawings. The embodiments are described below to explain the present invention by referring to the figures.

Figure 1:
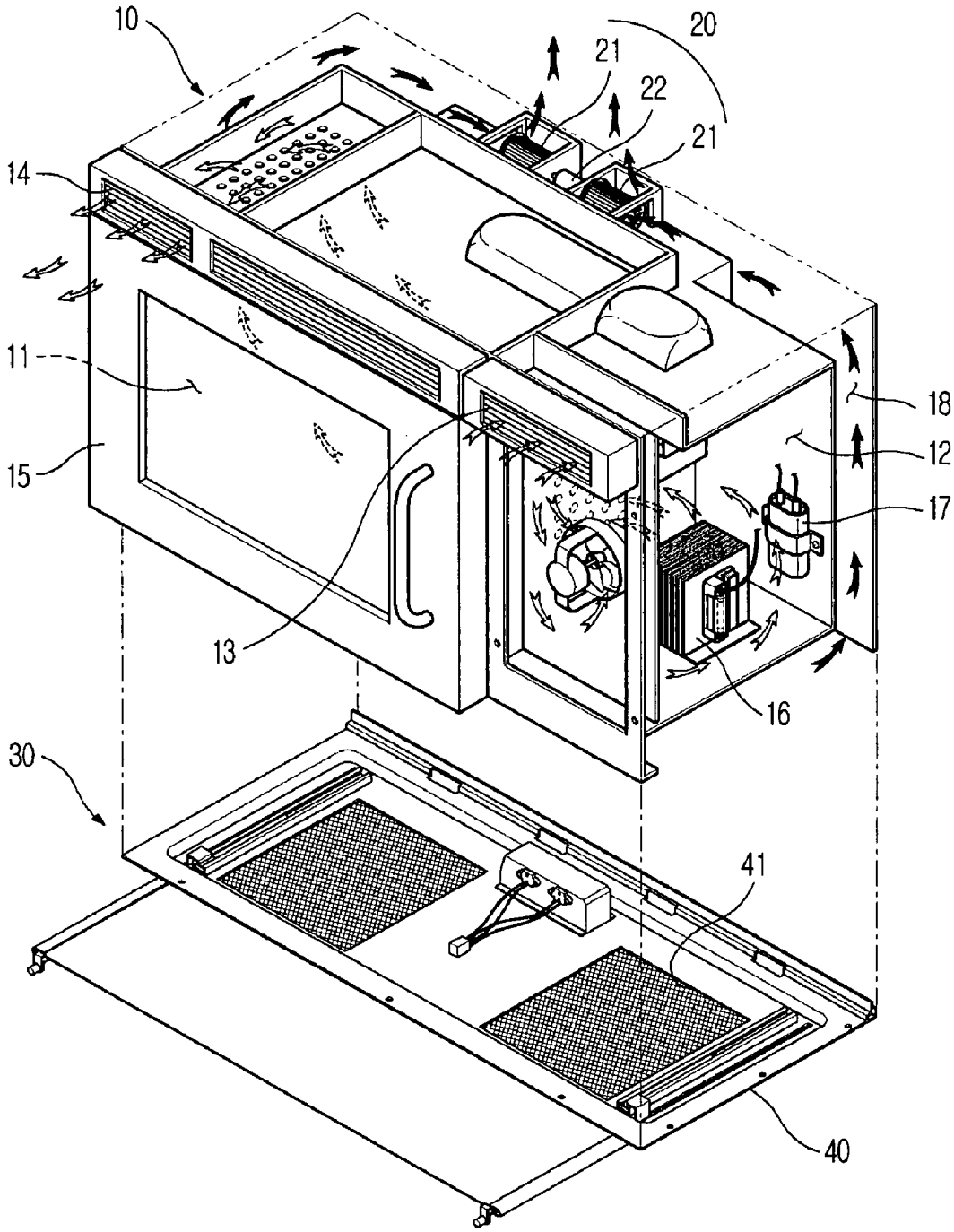
FIG. 1 is a perspective view schematically illustrating a configuration of a wall-mounted microwave oven according to a first embodiment of the present invention.
Figure 2:
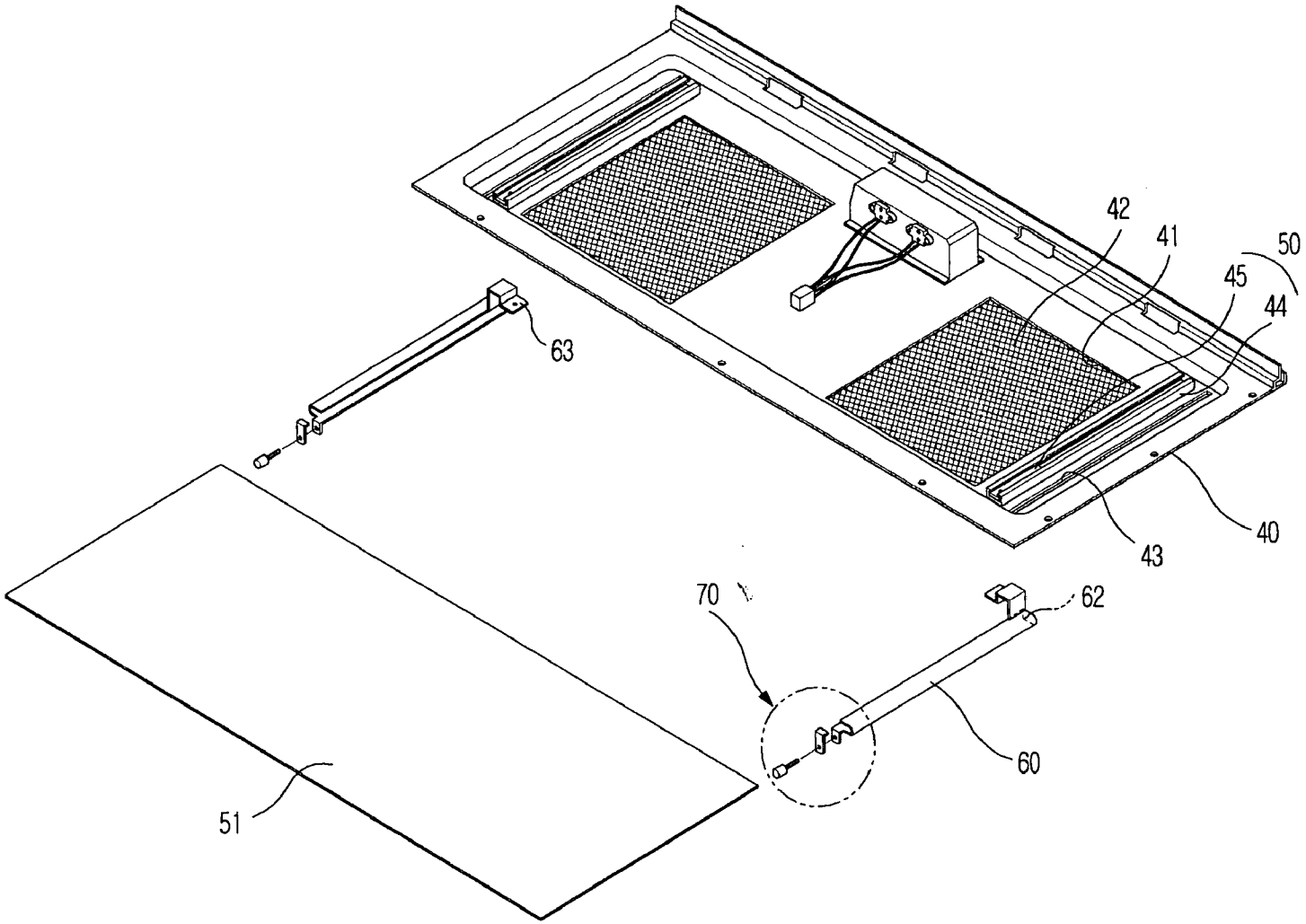
FIG. 2 is an exploded perspective view of a hood mover shown in FIG. 1.
Figure 3:
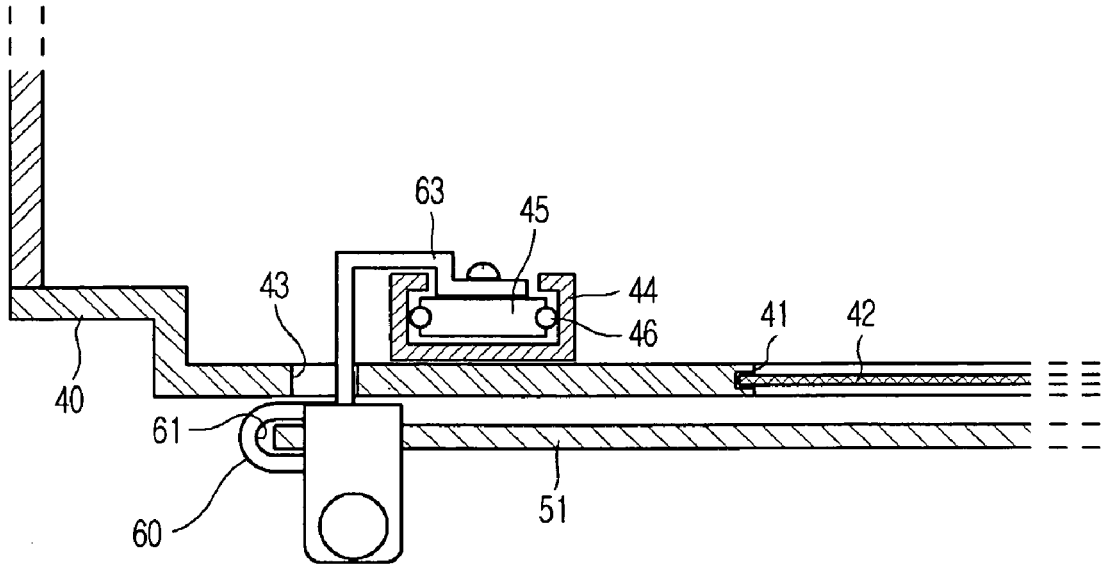
FIG. 3 is a front sectional view of the hood mover shown in FIG. 1.

FIG. 1 is a perspective view schematically illustrating a configuration of a wall-mounted microwave oven according to a first embodiment of the present invention. FIG. 2 is an exploded perspective view of a hood mover shown in FIG. 1. FIG. 3 is a sectional view of the hood mover shown in FIG. 1.

In accordance with the illustrated embodiment of the present invention, as shown in FIG. 1, the wall-mounted microwave oven includes a body 10 substantially having a box shape to define the outer appearance of the microwave oven, a cooking chamber 11 defined in the body 10, and an electric element chamber 12 defined in the body 10 to receive electric elements, etc. while being partitioned from the cooking chamber 11. The wall-mounted microwave oven also includes an exhauster to discharge, to the outdoors, exhaust gas and fumes emitted from another cooking appliance laid on the body 10, and a hood mover 30 installed at a lower case 40 constituting a part of the body 10, to guide exhaust gas and fumes to an inlet 41 formed through the lower case 40.

A front inlet 13 and a front outlet 14 are provided at a front upper portion of the body 10, in order to enable air to be circulated through the electric element chamber 12 and cooking chamber 11, and thus not only to cool the electric elements, but also to discharge moisture and food smell from the cooking chamber 11.

A door 15 is provided at an opened front side of the cooking chamber 11 such that the door 15 can pivot to open or close the cooking chamber 11. A high-voltage transformer 16 and a condenser 17 as the electric elements are arranged in the electric element chamber 12, to irradiate microwaves to the cooking chamber 11. Accordingly, it is possible to conduct heating and cooking operations for food, using microwaves irradiated to the food.

The exhauster 20 includes a pair of exhaust fans 21 arranged at a rear upper portion of the body 10, to discharge, to the outdoors, exhaust gas and fumes flowing through an exhaust passage 18, and a fan motor 22 to drive the exhaust fans 21.

The exhaust passage 18 is defined along the bottoms, opposite sides, and tops of the cooking chamber 11 and the electric element chamber 12 such that the exhaust passage 18 is partitioned from the cooking chamber 11 and electric element chamber 12. Exhaust gas or fumes guided by the hood mover 30 are introduced into the exhaust passage 18 through the inlet 41 formed through the lower case 40, and are then discharged to the outdoors after being guided toward the exhaust fans 21.

In the illustrated embodiment, the lower case 40, which is arranged at the bottom of the body 10, has a pair of inlets 41 to suck exhaust gas or food smells emitted from the other cooking appliance. A filter 42 is mounted at each inlet 41, to remove foreign matter contained in the exhaust gas, etc.

In accordance with the first embodiment of the present invention, the hood mover 30 is arranged beneath the lower case 40. Hereinafter, the hood mover 30 will be described in detail with reference to FIGS. 2 and 3. The hood mover 30 includes a hood plate 51 to guide exhaust gas or fumes emitted from the other cooking appliance to the inlets 41 of the lower case 40, a frame member 60 to support the hood plate 51, and a moving member 50 to move the frame member 60 with respect to the lower case 40. The moving member 50 includes a fixed rail 44 and a moving rail 45 mounted to the lower case 40, to enable the frame member 60 to slide with respect to the lower case 40 of the body 10. The moving rail 45 is connected to the frame member 60.

As shown in FIG. 3, the fixed rail 44 has an upwardly-opened channel shape. The moving rail 45 is inserted into a channel of the fixed rail 44. A plurality of ball bearings 46 are mounted to the moving rail 45, to cause the moving rail 45 to smoothly move along an inner surface of the fixed rail 44.

In the illustrated embodiment, the hood mover 30 includes a pair of frame members 60. The frame members 60 are formed with guide grooves 61 to separably receive opposite ends of the hood plate 51, respectively. A fastener 70 is formed at a front end of each frame member 60. A stopper 62 is provided at a rear end of each frame member 60, to prevent an excessive insertion of the hood plate 51.

An extension 63 is upwardly protruded from the rear end of each frame member 60, to couple the frame member 60 to the moving rail 45 inserted into the fixed rail 44 of the associated moving member 50. The extension 63 is upwardly inserted into the lower case 40 through a guide slot 43, and is then coupled to the moving rail 45. Accordingly, the moving rail 45 is linearly reciprocated within the fixed rail 44 when the frame member 60 extends or retracts. Thus, a smooth movement of the hood plate 51 is achieved.

In order to allow a forward/rearward movement of the extension 63 in a sliding manner, the guide slot 43 is formed through the lower case 40 such that the guide slot 43 extends in a forward/rearward direction to a sufficient length. The fixed rail 44 and moving rail 45 of each moving member 50 is arranged inwardly relative to the associated guide slot 43.

Each frame member 60 may have a 90°-rotated U-shaped structure to support the hood plate 51 while covering the associated end of the hood plate 51. In this case, the stopper 62 may be dispensed with. Each extension 63 may be integrated with the frame member 60, or may be formed in the form of a separate member. A packing member may be fitted in the guide groove 61 of each frame member 60, in order to strengthen the coupling of the frame member 60 with the hood plate 51. For each moving member 50, a configuration different from the configuration including the fixed rail 44 and moving rail 45 shown in FIGS. 2 and 3 may be implemented to slidably move the associated frame member 60 with respect to the lower case 40. Although an example, in which the fixed rail 44 and moving rail 45 of each moving member 50 is mounted on the lower case 40, has been illustrated, the fixed rail 44 and moving rail 45 may be mounted to a lower surface of a lateral case. A handle may be additionally provided at the hood plate 51, to enable the hood plate 51 to be drawn forward easily.

Figure 4A:
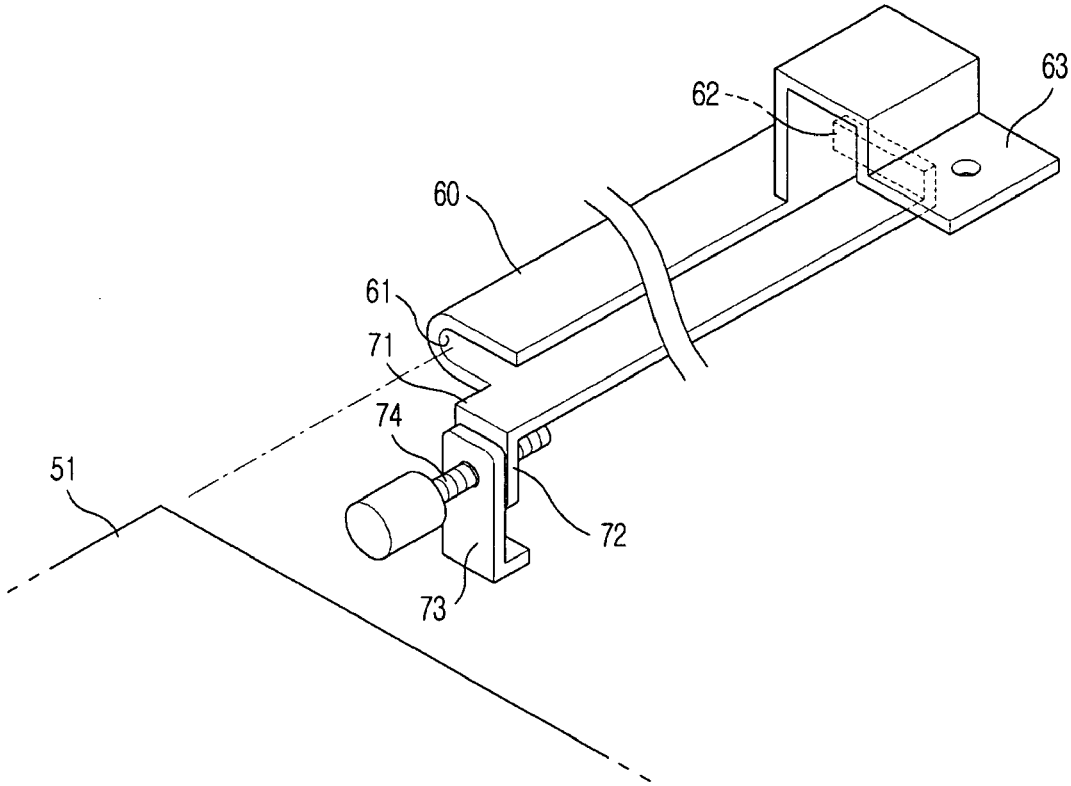
FIGS. 4A and 4B are perspective views illustrating exploded and assembled states of a hood plate and a frame member shown in FIG. 1, respectively.
Figure 4B:
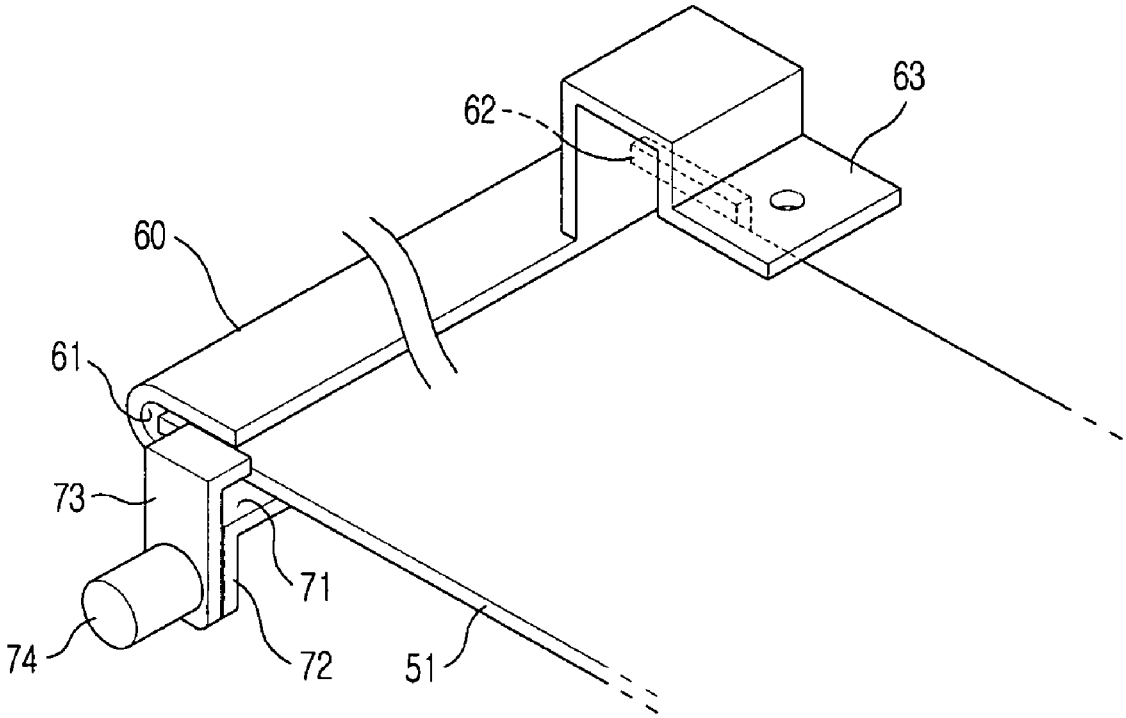

FIGS. 4A and 4B are perspective views illustrating exploded and assembled states of the hood plate and frame member shown in FIG. 1, respectively.

As shown in FIGS. 4A and 4B, each fastener 70 includes a fixed flange 72 downwardly bent from a protrusion 71 extending from a lower surface of the guide groove 61 of the associated frame member 60 at a front end of the guide groove 61, a separation preventing member 73 arranged in front of the fixed flange 72, to separably couple the hood plate 51 to the guide groove 61, and a screw 74 to fasten the separation preventing member 73 to the fixed flange 72.

In order to mount the hood plate 51, using the fasteners 70 having the above-described configuration, the user first unfastens the screws 74, and then rotates the separation preventing members 73, to enable the hood plate 51 to be inserted into the guide grooves 61 of the frame members 60 arranged at opposite sides of the lower case 40. Thereafter, the user inserts the hood plate 51 into the guide grooves 61, and then rotates the separation preventing members 73, to close the front ends of the guide grooves 61. Subsequently, the user reversely rotates the screws 74, to fasten the separation preventing members 73 to the fixed flanges 72, and thus, to prevent the hood plate 51 from being unintentionally separated.

When it is desired to separate the hood plate 51, the user rotates the screws 74, to unfasten the separation preventing members 73 from the fixed flanges 72. Thereafter, the user rotates the separation preventing members 73, to open the front end of the guide grooves 61, and then forwardly draws the hood plate 51, to separate the hood plate 51 from the frame members 60. The configuration of the fasteners 70 is an illustrative example. Fasteners having a configuration different from the illustrated configuration may be used to separably couple the hood plate 51 to the frame members 60. For example, a fastener having a 90°-rotated U shape may be pivotally coupled to each frame member 60 by a hinge. In this case, a coupling member may be provided at an upper portion of the frame member 60, to fasten the fastener.

Figure 5A:
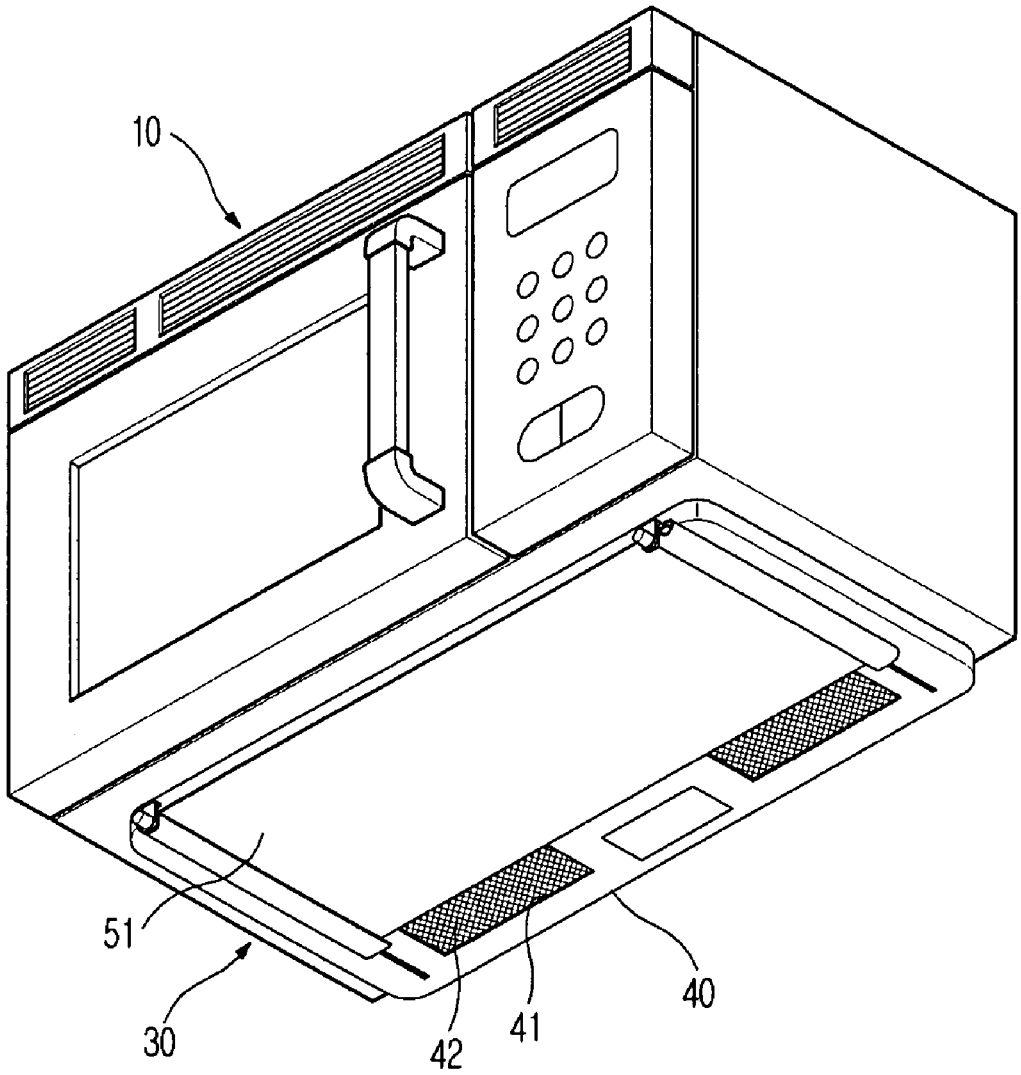
FIGS. 5A and 5B are perspective views illustrating operating states of the hood mover according to the first embodiment shown in FIG. 1.
Figure 5B:
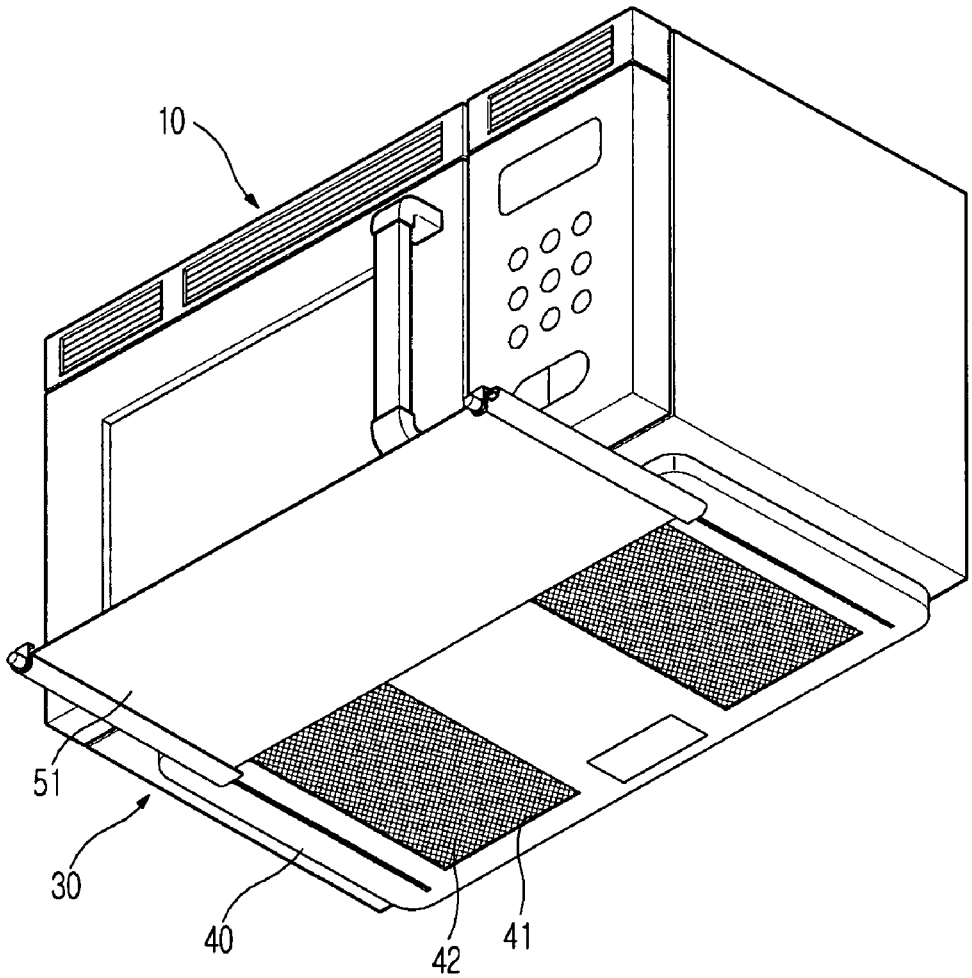

FIGS. 5A and 5B are perspective views illustrating operating states of the hood mover according to the first embodiment shown in FIG. 1.

As shown in FIG. 5A, the wall-mounted microwave oven having the above-described configuration according to the first embodiment of the present invention is normally maintained in a state in which the hood plate 51 partially closes the inlets 41 of the lower case 40. Since the user may perform a cooking operation in a state in which the hood plate 51 is not forwardly moved, the wall-mounted microwave oven is designed such that the inlets 41 of the lower case 40 are prevented from being completely closed by the hood plate 51. It is also preferred that the position of the hood plate 51 in a state, in which the hood plate 51 is retracted, correspond to a position where a major portion of exhaust gas emitted from another cooking appliance arranged beneath the hood plate 51 reaches.

When the user manually forwardly draws the hood plate 51 in the above-described state, to discharge, to the outdoors, exhaust gas, fumes, etc. emitted from a front portion of the cooking appliance arranged beneath the hood plate 51, the outlets 41 of the lower case 40 are opened to an increased opening degree, as shown in FIG. 5B. In this state, exhaust gases, etc. are guided to the inlets 41 by the hood plate 51 positioned at a forwardly-extended position, so that the exhaust gas, etc. can be discharged to the outdoors. That is, as the hood plate 51 is forwardly drawn, exhaust gas, etc. rising toward the hood plate 51 is intercepted by the hood plate 51, and is guided toward the inlets 41 of the lower case 40 by a suction force from the exhaust fans 21. Thus, the suction efficiency of the hood is enhanced.

The exhauster 20 may be driven in response to the drawing of the hood plate 51. Alternatively, a separate switch may be provided to control the driving of the exhauster 20. In this case, the exhauster 20 is selectively driven in accordance with an ON/OFF operation of the switch. In the case, in which the exhauster 20 is driven in response to the movement of the hood plate 51, a configuration to sense the forward drawing of the hood plate 51 is additionally provided, to automatically drive the exhauster 20 when the hood plate 51 is forwardly drawn.

As described above, where the wall-mounted microwave oven according to the first embodiment of the present invention is used, oil and dirt may be attached to the hood plate 51 and the coupling portions of the hood plate 51 and frame members 60 due to exhaust gas, fumes, etc. emitted from the other cooking appliance. In this case, the user can separate the hood plate 51 from the frame members 60, using a simple method, and can easily clean the separated hood plate 51.

After the cleaning, the user can couple the hood plate 51 to the frame members 60, using a simple method.

Since the hood plate 51 is installed outside the lower case 40 of the body, oil and dirt, which will be attached to the lower case 40, are attached to the hood plate 51 when the hood plate 51 is used without being forwardly drawn. In this case, accordingly, it is possible to use the lower case 40 of the body in a clean state, without causing the lower case 40 to be contaminated by oil and dirt.

Hereinafter, a wall-mounted microwave oven according to a second embodiment of the present invention will be described.

Figure 6:
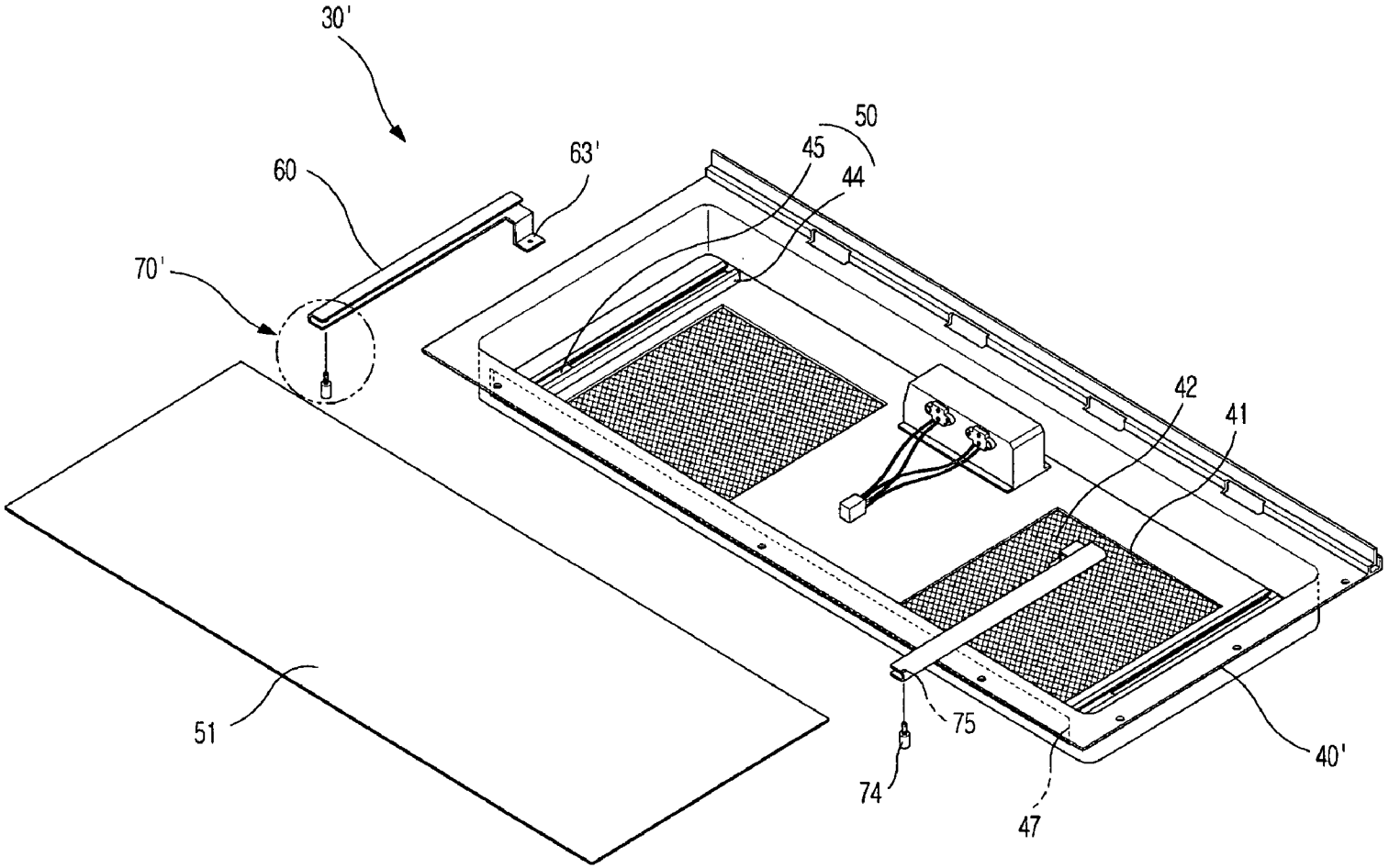
FIG. 6 is an exploded perspective view illustrating a hood mover according to a second embodiment of the present invention.
Figure 7:
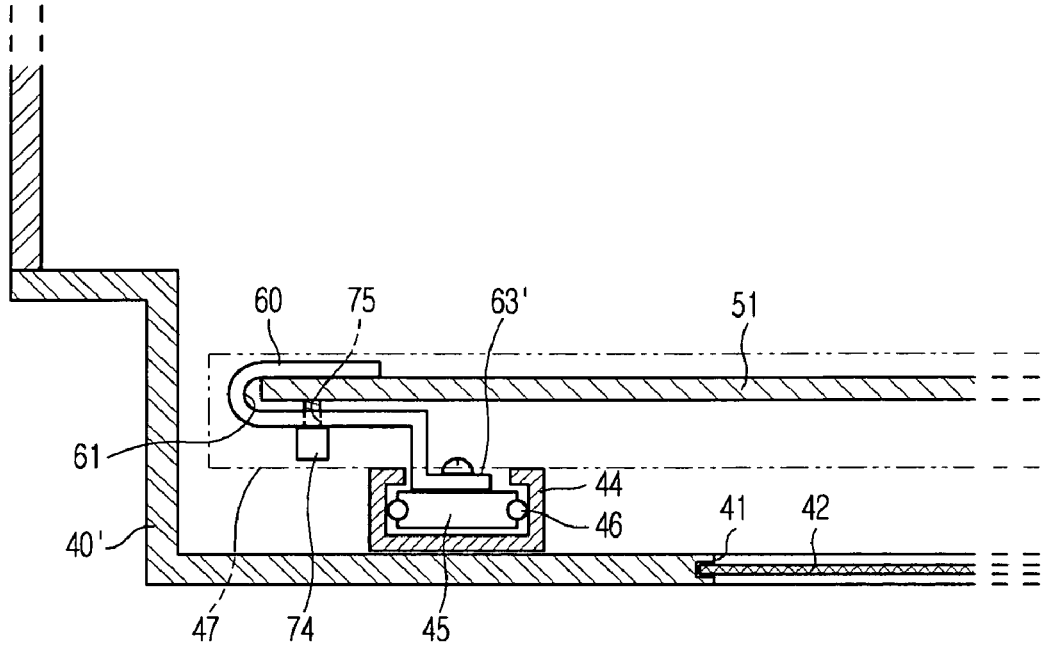
FIG. 7 is a front sectional view of a hood mover shown in FIG. 6.

FIG. 6 is an exploded perspective view illustrating a hood mover included in the wall-mounted microwave oven according to the second embodiment of the present invention. FIG. 7 is a front sectional view of the hood mover shown in FIG. 6. The constituent elements of the second embodiment identical to those of the first embodiment will be designated by the same reference numerals, respectively, and no description thereof will be given.

The hood mover 30' of the wall-mounted microwave oven according to the second embodiment of the present invention has a configuration substantially identical to that of the first embodiment, except that the hood mover 30' is not arranged outside a lower case 40' of the body, but is arranged inside the lower case 40'.

The hood mover 30' of the wall-mounted microwave oven according to the second embodiment of the present invention is arranged over the lower case 40' such that the hood mover 30' can extend or retract, as shown in FIGS. 6 and 7.

The hood mover 30' includes a hood plate 51 to guide exhaust gas or fumes emitted from another cooking appliance arranged beneath the wall-mounted microwave oven to the lower case 40', frame members 60 to support the hood plate 51, and moving members to move the associated frame members 60 with respect to the lower case 40'. Each moving member includes a fixed rail 44 and a moving rail 45 mounted to the lower case 40', to enable the associated frame member 60 to slide with respect to the lower case 40'.

Guide grooves 61 are formed at the frame members 60, to separably receive opposite ends of the hood plate 51, respectively. An extension 63' is formed at each frame member 60. The extension 63' couples the associated frame member 60 to the moving rail 45 inserted into the fixed rail 44 of the associated moving member. The hood mover 30' also includes fasteners 70' to separably couple the hood plate 51 to the frame members 60, respectively.

Since the hood mover 30' is arranged over the lower case 40' in accordance with the second embodiment, the extension 63' is downwardly protruded to be coupled to the associated moving rail 45.

In accordance with this embodiment, the fastener 70' has a relatively simple configuration including a screw 74 to fasten the hood plate 51 to the associated guide groove 61, and a screw hole 75 formed at one surface of the associated frame member 60, in which a channel is defined. In order to mount the hood plate 51, the user first unfastens the screws 74, and then inserts the hood plate 51 into the guide grooves 61 of the frame members 60 arranged at opposite sides of the lower case 40'. The user then rotates the screws 74, to fasten the hood plate 51 to the inner surfaces of the guide grooves 61. Thus, the hood plate 51 is firmly coupled to the frame members 60.

When it is desired to separate the hood plate 51, the user reversely rotates the screws 74, to release the coupling force between the hood plate 51 and each guide groove 61. Thereafter, the user forwardly draws the hood plate 51, to separate the hood plate 51 from the frame members 60.

Since the hood mover 30' is arranged over the lower case 40', different from the first embodiment, it is unnecessary to provide the above-described guide holes 43 at the lower case 40'. Instead, an opening 47, which has a width larger than the width of the structure including the hood plate 51 and the frame members 60, is formed through a front wall of the lower case 40' at a lower portion of the lower case 40'.

As described above, in accordance with the second embodiment of the present invention, it is possible to achieve a separation of the hood plate 51, while maintaining the appearance of the body in a beautiful state. That is, when the hood plate 51 is contaminated by exhaust gas, fumes, etc. emitted from the other cooking appliance, it is possible to easily separate the hood plate 51, and thus to easily clean the separated hood plate 51. After the cleaning, it is possible to couple the hood plate 51 to the frame members 60, using a simple method.

Figure 8:
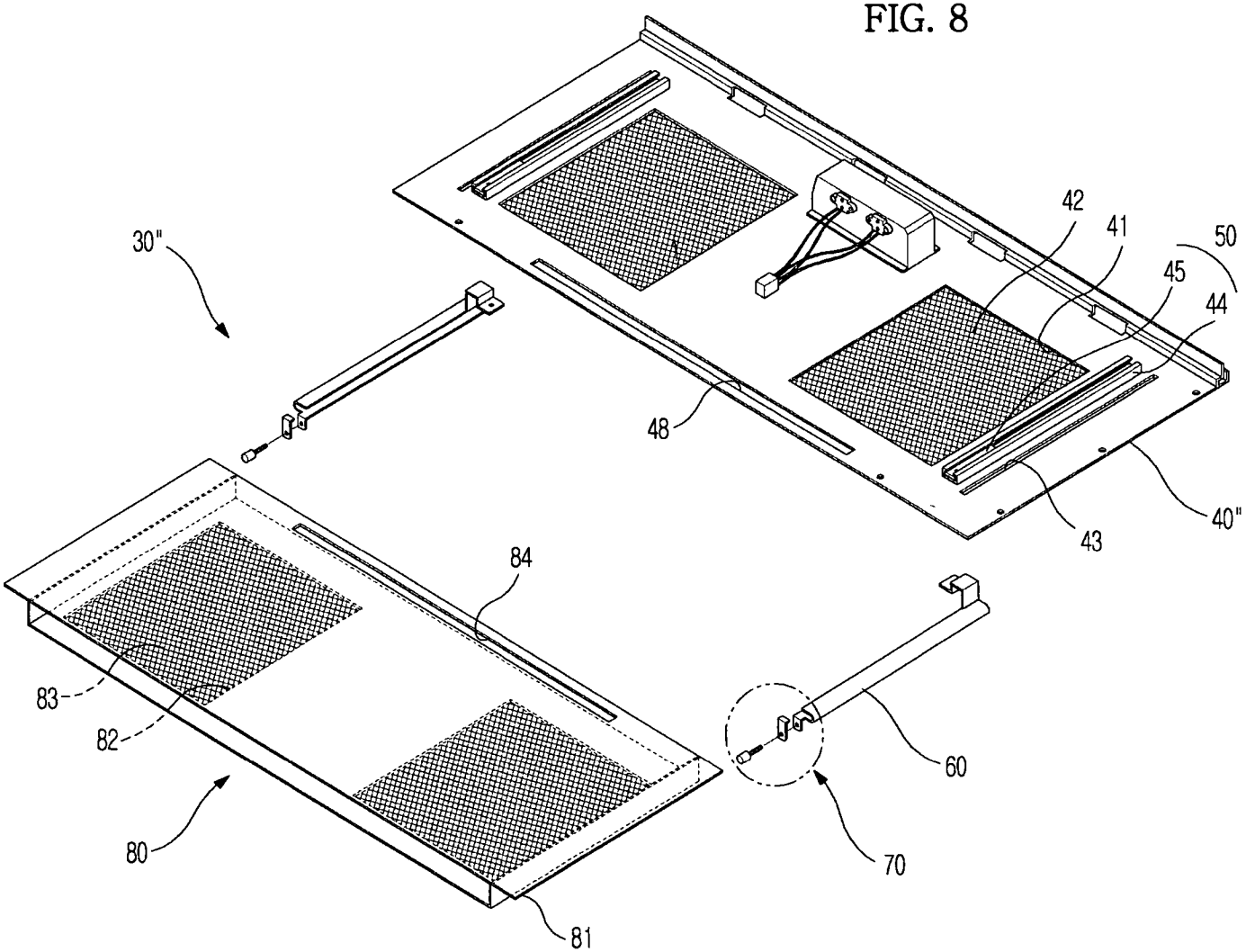
FIG. 8 is an exploded perspective view illustrating a hood mover according to a third embodiment of the present invention.

Hereinafter, a wall-mounted microwave oven according to a third embodiment of the present invention will be described with reference to FIGS. 8 and 9. The constituent elements of the third embodiment identical to those of the first embodiment will be designated by the same reference numerals, respectively, and no description thereof will be given.

The configuration of the third embodiment is substantially identical to that of the first embodiment, except that a hood mover 30" includes a hood plate 80 provided with suction ports 82, filters 83, and an internal exhaust passage 85, instead of the plate-shaped hood plate 51. This will be described in detail hereinafter.

The lower case 40" of the body 10 has a pair of inlets 41 to suck exhaust gas or food smell emitted from the other cooking appliance. The filters 42 are separably mounted at the inlets 41, respectively, to remove foreign matter contained in exhaust gas, etc.

A communicating port 48 is provided at the lower case 40", to communicate with an outlet 84 formed at the hood plate 80 when the hood plate 80 is drawn. The outlet 84 will be described later. Accordingly, exhaust gas, fumes, etc. introduced through the hood plate 80 are guided to the internal exhaust passage 85 defined in the lower case 40".

In addition to the hood plate 80, the hood mover 30" includes frame members 60 to support the hood plate 80, and moving members to move the associated frame members 60 with respect to the lower case 40". Each moving member includes a fixed rail 44 and a moving rail 45. The configuration of the hood mover 30" except for the hood plate 80 is identical to that of the first embodiment.

The hood plate 80 includes suction ports 82 to suck exhaust gas, etc., filters 83 respectively arranged at the suction ports 82, an outlet 84 to guide the exhaust gas, etc. sucked through the suction ports 82 to the lower case 40", and fitting portions 81 to enable the coupling and separation of the hood plate 80 with respect to the frame members 60.

It is possible to couple the hood plate 80, which has the above-described configuration, to the frame members 60 by fitting the fitting portions 81 in the guide grooves 61 of the frame members 60, and fixing the fitting portions 81 in the same manner as the first embodiment, using fasteners 70. In the same manner as the first embodiment, it is also possible to separate the hood plate 80 from the frame members 60.

Figure 9:
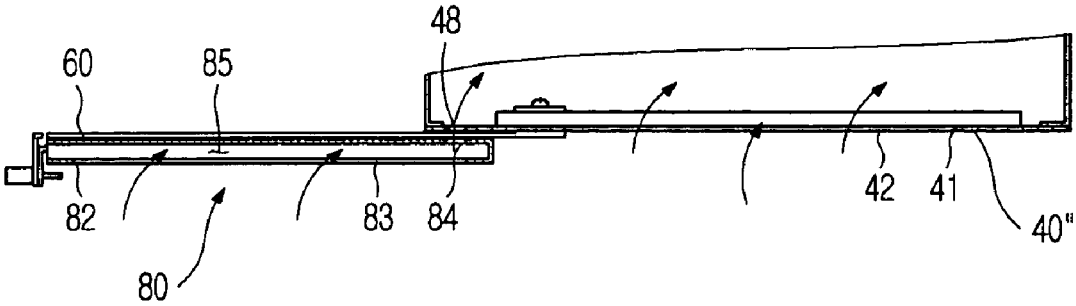
FIG. 9 is a front sectional view of a hood mover shown in FIG. 8.

In accordance with the third embodiment, it is possible to suck exhaust gas, etc. in a relatively wide region when the hood plate 80 is forwardly drawn, as shown in FIG. 9. The exhaust gas, etc. introduced through the hood plate 80 is guided along the internal exhaust passage 85, and is then discharged through the outlet 84. Thereafter, the exhaust gases, etc. are guided to the exhaust passage 18 via the communicating port 48 of the lower case 40", and are then discharged to the outdoors.

Although not shown, a design alteration may be implemented in the third embodiment such that the hood plate 80 is arranged inside the lower case 40", as in the second embodiment. That is, the hood plate 80 may be configured to have an opened rear end, instead of the outlet 84 formed at a top portion of the hood plate 80, while still including the suction ports 82, filters 83, and internal exhaust passage 85. Also, an opening may be formed at a front wall of the lower case 40", instead of the communicating port 84 of the lower case 40".

In accordance with the third embodiment, it is possible to discharge exhaust gas, etc. sucked in a wider region to the outdoors because the suction of exhaust gas, etc. can be achieved not only through the lower case 40", but also through the hood plate 80, when the hood plate 80 is forwardly drawn. Even when the hood plate 80 is maintained in a retracted state, without being forwardly drawn, there is no degradation in exhaustion efficiency because the area of the inlets 41 of the lower case 40" is not reduced. Since the user can simply achieve the separation or coupling of the hood plate 80 with respect to the frame members 60 in the same manner as the first embodiment, it is possible to easily clean the hood plate 80.

Hereinafter, a wall-mounted microwave oven according to a fourth embodiment of the present invention will be described with reference to FIGS. 10 to 13. The constituent elements of the fourth embodiment identical to those of the first embodiment will be designated by the same reference numerals, respectively, and no description thereof will be given.

Figure 10:
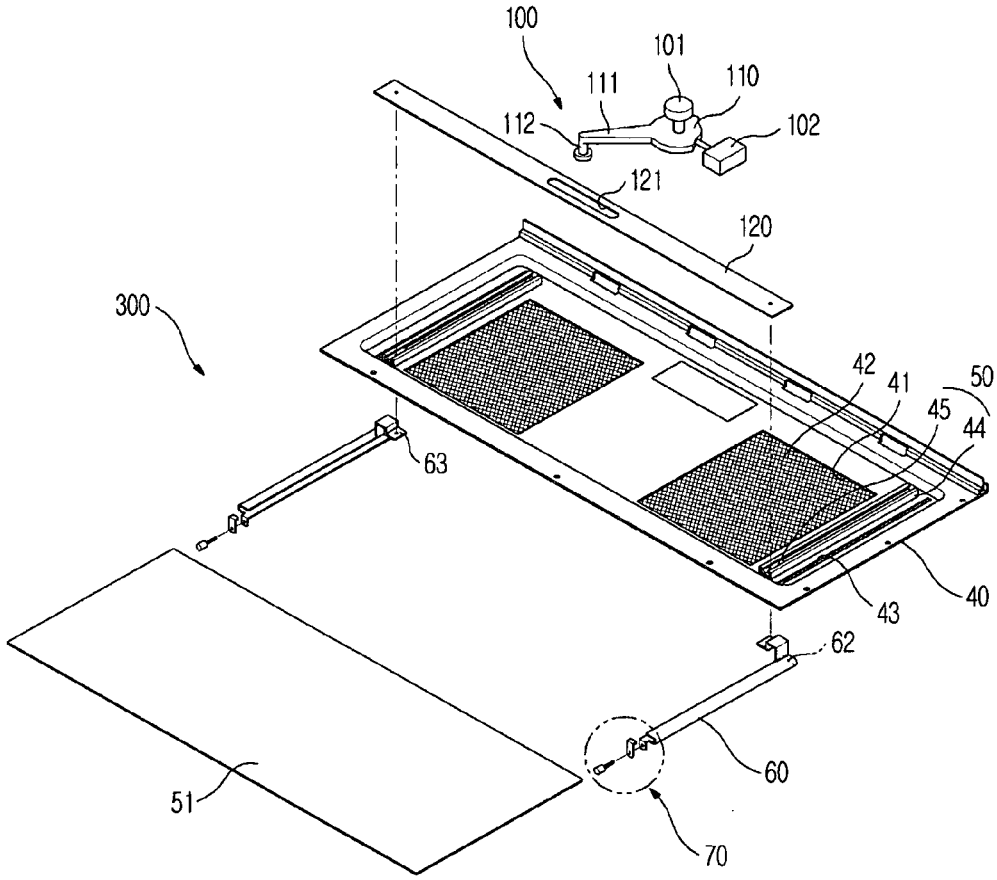
FIG. 10 is an exploded perspective view illustrating a hood mover according to a fourth embodiment of the present invention.
Figure 11:
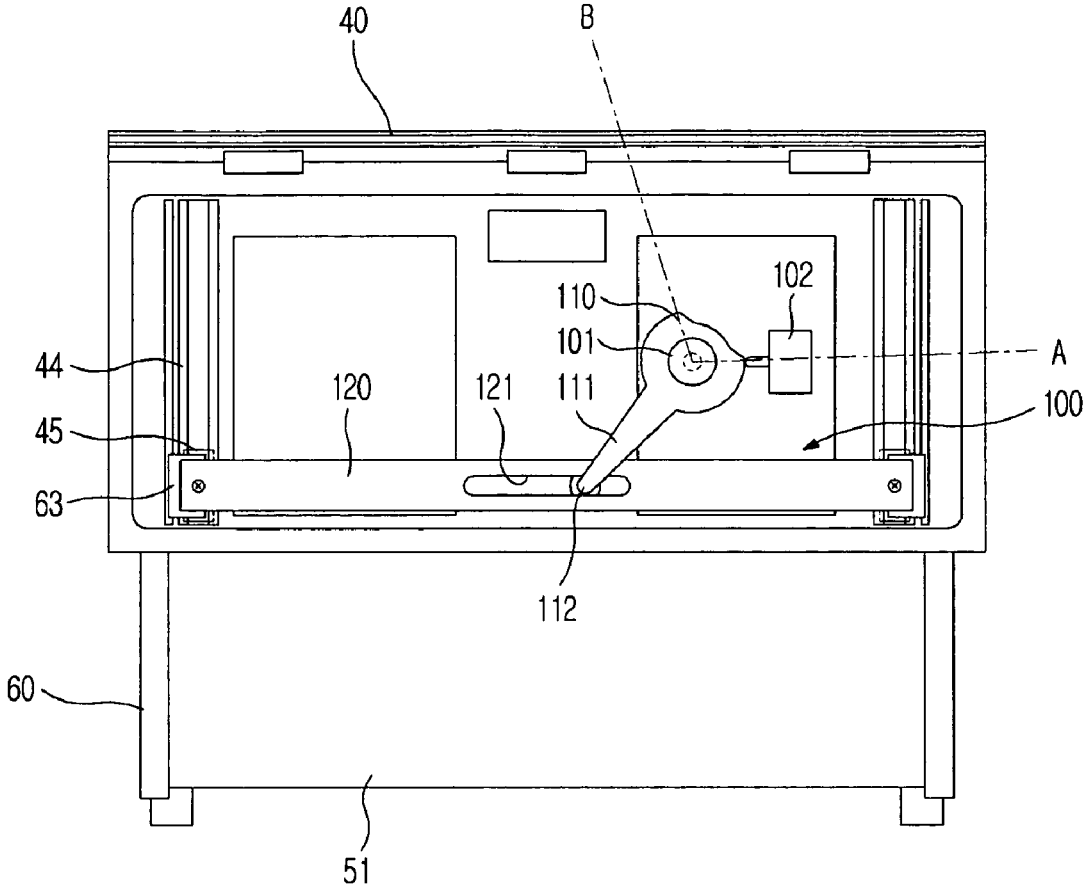
FIG. 11 is a plan view illustrating an extended state of a hood plate shown in FIG. 10.
Figure 12:
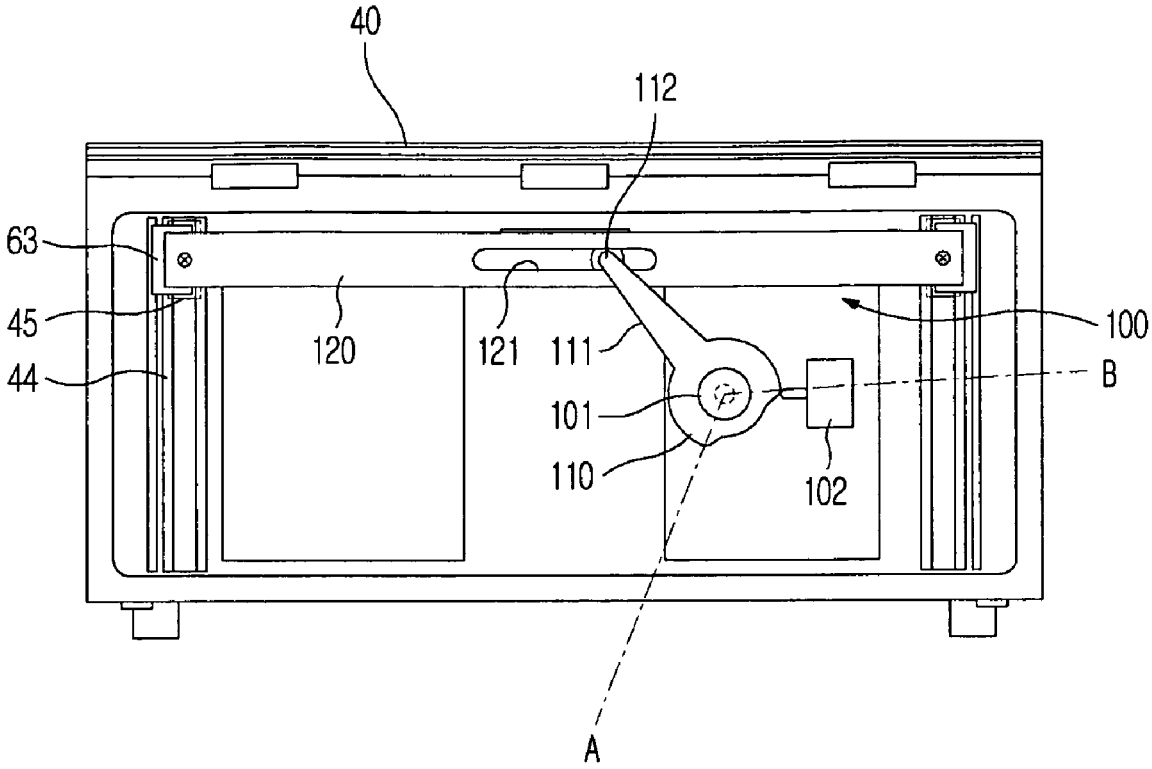
FIG. 12 is a plan view illustrating a retracted state of the hood plate shown in FIG. 10.
Figure 13:
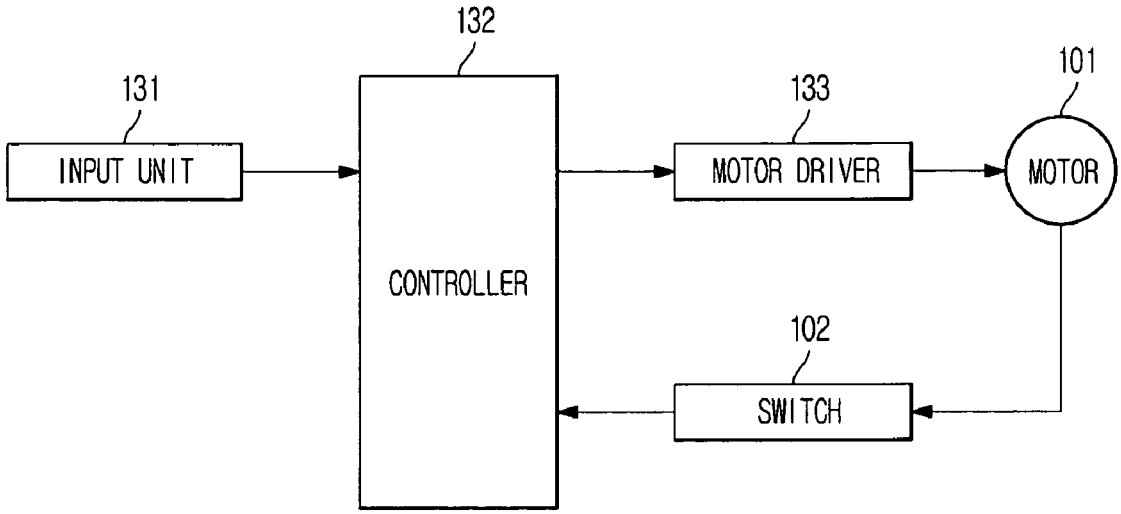
FIG. 13 is a block diagram illustrating a control configuration according to the fourth embodiment of the present invention.

FIG. 10 is an exploded perspective view illustrating a hood mover according to the fourth embodiment of the present invention. FIG. 11 is a plan view illustrating an extended state of a hood plate shown in FIG. 10. FIG. 12 is a plan view illustrating a retracted state of the hood plate shown in FIG. 10. FIG. 13 is a block diagram illustrating a control configuration according to the fourth embodiment of the present invention.

The wall-mounted microwave oven of the fourth embodiment has a configuration substantially identical to that of the first embodiment, except that the wall-mounted microwave oven includes a driving unit 100, which will be described later. That is, a hood mover 300, which is included in the wall-mounted microwave oven of the fourth embodiment, includes the driving unit 100. The driving unit 100 functions to automatically slide the hood plate 51 such that the hood plate 51 moves forward to the outside of the lower case 40, or moves backward to a lower portion of the lower case 40.

In the wall-mounted microwave oven according to the fourth embodiment of the present invention, the driving unit 100 includes a driving motor 101 to generate a driving force causing a normal or reverse rotation, a cam 110 coupled to a rotating shaft of the driving motor 101 such that the cam 110 is rotated by the rotating shaft, a lever 111 extending from the cam 110, a connecting member 120 moving forward or backward in accordance with a rotation of the lever 111, to change the rotation of the lever 111 to a linear movement, and a switch 102 to turn on/off in accordance with the rotation of the cam 110.

The driving motor 101 may be appropriately mounted to the bottom of the cooking chamber defined in the body 10 or to the lower case in accordance with the installation position of the hood mover. The driving motor 101 comprises a motor rotatable in normal and reverse directions to rotate the lever 111 in normal and reverse directions. The cam 110, which is axially coupled to the driving motor 101, is arranged to press the switch 102 when the cam 110 rotates by a certain angle, and thus to turn on/off the switch 102.

A protrusion 112 is formed at an end of the lever 111 extending from the cam 110, to transmit the rotating force from the lever 111 to the connecting member 120. The connecting member 120 is formed with a slot 112 to receive the protrusion 112. When the lever 111 is rotated by the driving motor 101, the rotating force from the lever 111 is transmitted to the connecting member 120 via the lever 111 and protrusion 112. As a result, the rotation is changed to a linear reciprocation movement of the connecting member 120 by the slot 121 formed through the connecting member 120. Thus, the connecting member 120 moves forward or backward.

The connecting member 120 is connected to the extensions 63 of the frame members 60 at opposite ends of the connecting member 120, respectively. Accordingly, the frame members 60 are moved to extend forward or retract backward in accordance with the forward extension or backward retraction of the connecting member 120. The connecting member 120 may be directly coupled to the moving rails 45, instead of the extensions 63 of the frame members 60, to transmit a driving force.

FIG. 13 is a block diagram illustrating a control configuration in the wall-mounted microwave oven according to the fourth embodiment of the present invention. For the control configuration, the wall-mounted microwave oven of the fourth embodiment further includes an input unit 131, a controller 132, and a motor driver 133.

The input unit 131 generates an input signal to cause the hood plate 51 to move forward or backward, in accordance with a user's selection. The input unit 131 is provided in the form of a button at the front surface of the body 10. The controller 132 receives the input signal from the input unit 131, and controls the driving motor 101, based on the received input signal. When the user operates the input unit 131 to apply a signal to the controller 132, in order to cause the hood plate 51 to move forward or backward, the controller 132 drives the driving motor 101 via the motor driver 133, in response to the applied signal. In accordance with the driving of the driving motor 101, the cam 110 axially coupled to the driving motor 101 is rotated. The switch 102 performs an ON/OFF operation in accordance with the rotation of the cam 110. A signal, which is generated in accordance with the ON/OFF operation of the switch 102, is sent to the controller 132. In response to the signal from the switch 102, the controller 132 controls the motor driver 133 to drive the driving motor 101 or to stop the driving of the driving motor 101.

Hereinafter, the mechanism to move the head plate forward or backward by a driving force will be described in more detail. When the user operates the input unit 131 to apply a signal to the controller 132, in order to cause the hood plate 51 to be drawn, the controller 132 drives the driving motor 101 via the motor driver 133, in response to the applied signal.

In accordance with the driving of the driving motor 101, the cam 110 axially coupled to the driving motor 101 and the lever 111 are rotated. As a result, the protrusion 112 formed at the end of the lever 111 moves the connecting member 120 forward while sliding along the slot 121 of the connecting member 120. Accordingly, the frame members 60 coupled to the connecting member 120 and the hood plate 51 coupled to the frame members 60 are moved forward, as shown in FIG. 11.

When the cam 110 is rotated by a predetermined angle (to a position A in FIG. 11) in accordance with the driving of the driving motor 101, the switch 102 is pressed by the cam 110, so that the switch 102 changes the operation state thereof from an OFF state to an ON state. The resultant signal from the switch 102 is sent to the controller 132. Based on the signal from the switch 102, the controller 132 senses the fact that the hood plate 51 has moved to a maximum forward position, and stops the driving motor 101. Thus, the hood plate 51 is maintained at the maximum forward position.

On the other hand, when the user operates the input unit 131 to apply a signal to the controller 132, in order to cause the hood plate 51 to return to a position beneath the lower case 40, the controller 132 drives the driving motor 101 in response to the applied signal. In this case, the controller 132 controls the driving motor 101 such that the rotation direction of the driving motor 101 is reversed in response to every signal from the input unit 131. In accordance with the driving of the driving motor 101, the cam 110 axially coupled to the driving motor 101 and the lever 111 are rotated in a reverse direction. As a result, the protrusion 112 formed at the end of the lever 111 moves the connecting member 120 backward while sliding along the slot 121 of the connecting member 120. Thus, the hood plate 51 is returned, as shown in FIG. 12.

When the cam 110 is rotated in reverse by a predetermined angle (to a position B in FIG. 12) in accordance with the driving of the driving motor 101, the switch 102 is pressed by the cam 110, so that the switch 102 changes the operation state thereof from the OFF state to the ON state. The resultant signal from the switch 102 is sent to the controller 132. Based on the signal from the switch 102, the controller 132 senses the fact that the hood plate 51 has moved to a maximum backward position, and stops the driving motor 101. Thus, the hood plate 51 is maintained at a returned position corresponding to the maximum backward position.

In the wall-mounted microwave oven according to the fourth embodiment of the present invention, it is possible not only to achieve the separation and coupling of the hood plate in the same manner as the first embodiment, but also to automatically move the hood plate in forward and backward directions by the driving unit, which has a relatively simple structure.

Hereinafter, a wall-mounted microwave oven according to a fifth embodiment of the present invention will be described with reference to FIGS. 14 to 16. The constituent elements of the fifth embodiment identical to those of the fourth embodiment will be designated by the same reference numerals, respectively, and no description thereof will be given.

Figure 14:
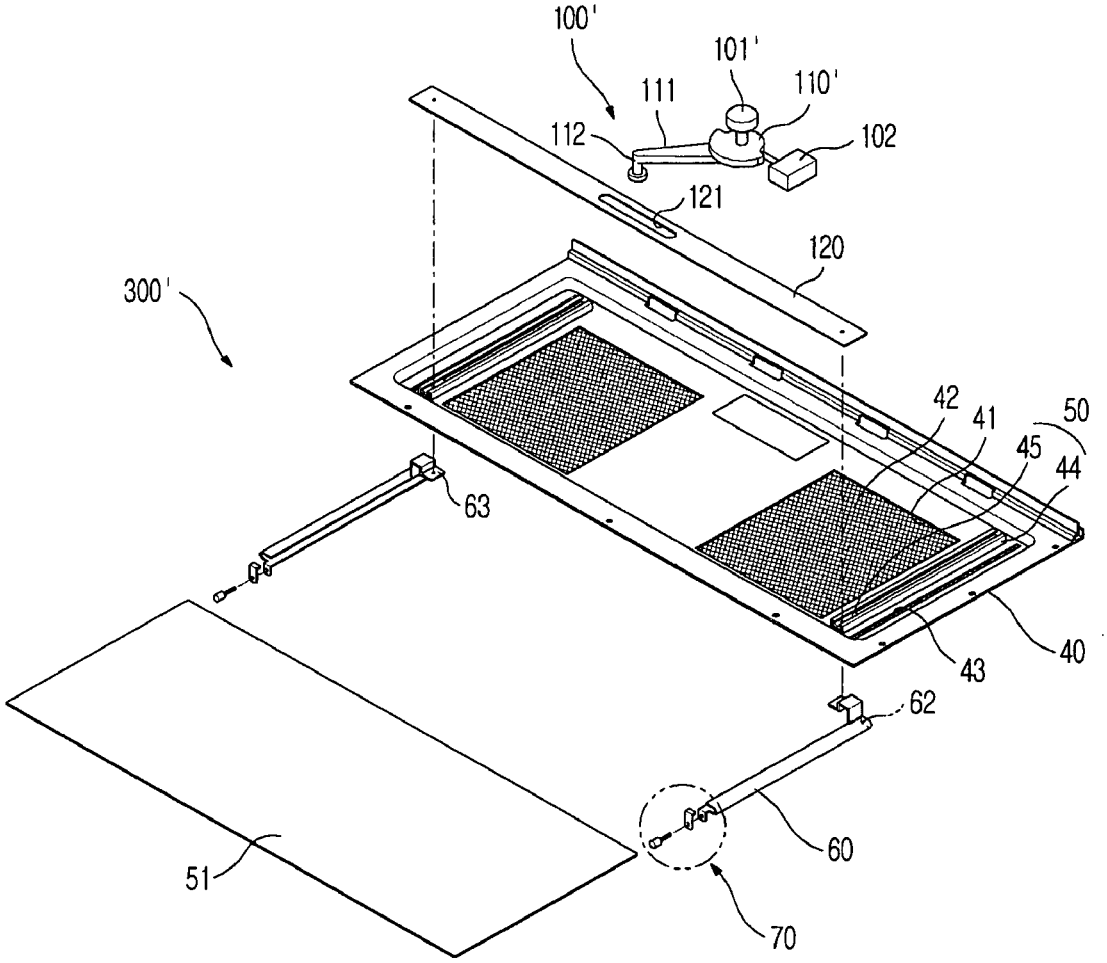
FIG. 14 is an exploded perspective view illustrating a hood mover according to a fifth embodiment of the present invention.

FIG. 14 is an exploded perspective view illustrating a hood mover according to the fifth embodiment of the present invention. FIG. 15 is a plan view illustrating an extended state of a hood plate shown in FIG. 14. FIG. 16 is a plan view illustrating a retracted state of the hood plate shown in FIG. 14.

The wall-mounted microwave oven of the fifth embodiment has a configuration substantially identical to that of the fourth embodiment, except that the wall-mounted microwave oven includes a driving unit 100' including a driving motor 101', which generates a driving force causing a rotation in one direction. In addition to the driving motor 101', which generates a driving force causing a rotation in one direction, the driving unit 100' includes a cam 110' coupled to the driving motor 101' such that the cam 110' is rotated by the driving motor 101', a lever 111 arranged beneath the cam 110', and coupled to the driving motor 101, a connecting member 120 moving to extend or retract in accordance with a rotation of the lever 111, and a switch 102 to turn on/off in accordance with the rotation of the cam 110.

In order to achieve a reduction in costs, the driving motor 101' comprises a driving motor rotatable in one direction. The driving motor 101' is mounted to the bottom of the cooking chamber defined in the body 10. The cam 110' is axially coupled to the driving motor 101'. The cam 110' has cam portions having different radiuses while extending by 180°, respectively. In accordance with every 180° rotation of the cam 110', the switch 102 changes the operation state thereof between an ON state and an OFF state by a pressing force from the cam 110'.

The general configuration of a hood mover 300' according to the fifth embodiment and the control operation for the hood mover 300' are identical to those of the fourth embodiment. Hereinafter, the operation principle of the fifth embodiment will be described in detail.

When the input unit 131 generates an input signal to cause the hood plate 51 to be drawn, in accordance with a user's selection, the controller 132 receives the input signal from the input unit 131, and drives the driving motor 101' via the motor driver 133, based on the received input signal. In accordance with the driving of the driving motor 101', the cam 110 axially coupled to the driving motor 101' and the lever 111 are rotated. As a result, the protrusion 112 formed at the end of the lever 111 forwardly moves the connecting member 120 while sliding along the slot 121 of the connecting member 120. Accordingly, the frame members 60 coupled to the connecting member 120 and the hood plate 51 coupled to the frame members 60 are forwardly moved, as shown in FIG. 15.

Figure 15:
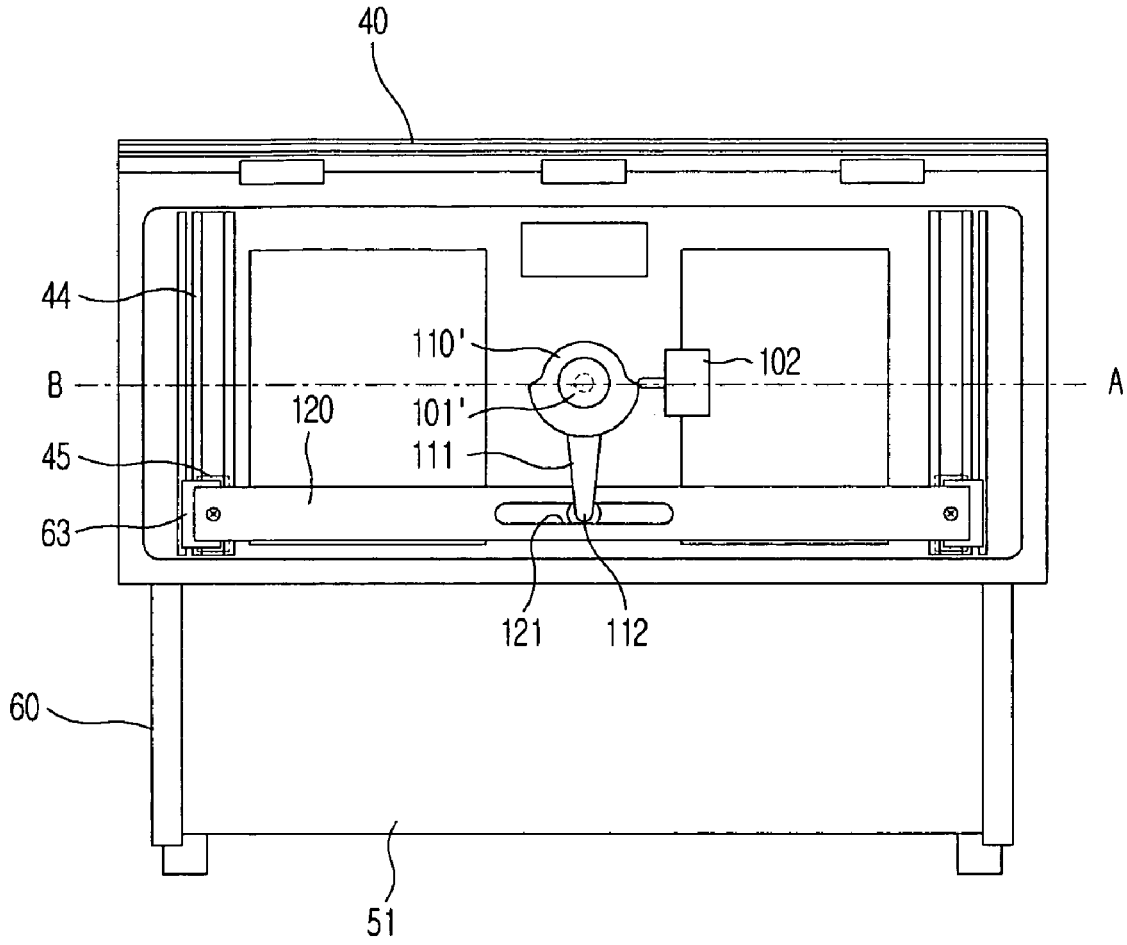
FIG. 15 is a plan view illustrating an extended state of a hood plate shown in FIG. 14.
Figure 16:
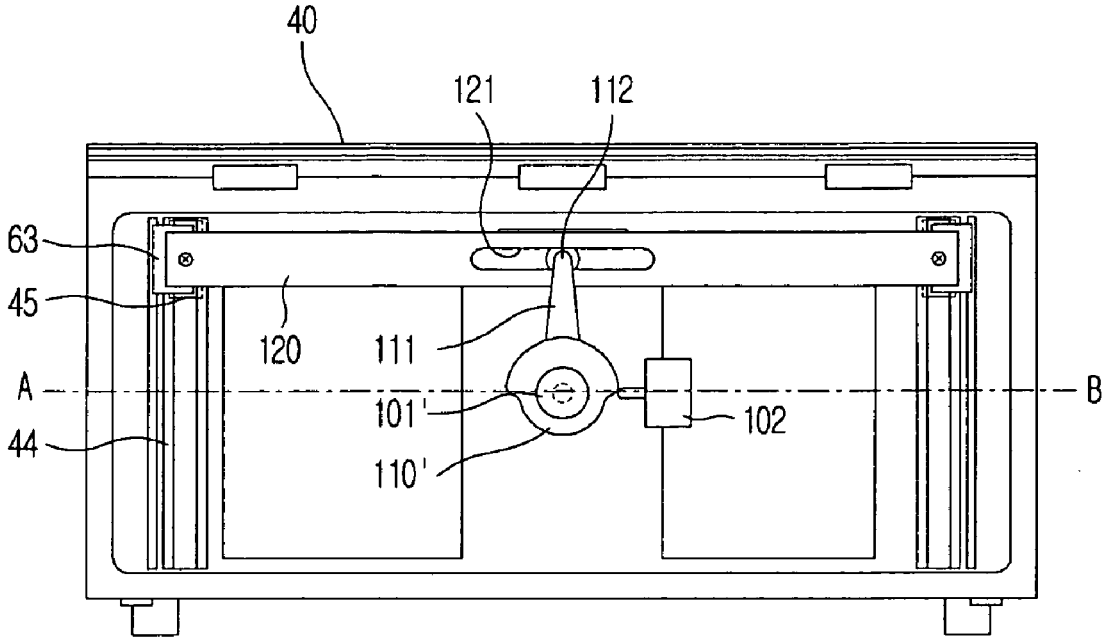
FIG. 16 is a plan view illustrating a retracted state of the hood plate shown in FIG. 14.

When the cam 110' reaches a position A in FIG. 15 while being rotated in accordance with the driving of the driving motor 101', the switch 102 is pressed by the cam 110', so that the switch 102 changes the operation state thereof from an OFF state to an ON state. The resultant signal from the switch 102 is sent to the controller 132. Based on the signal from the switch 102, the controller 132 senses the fact that the hood plate 51 has moved to a maximum forward position, and stops the driving motor 101'. Thus, the hood plate 51 is maintained at the maximum forward position.

On the other hand, when the user operates the input unit 131 to apply a signal to the controller 132, in order to cause the hood plate 51 to return to a position beneath the lower case 40, the controller 132 drives the driving motor 101' in the same direction as described above, in response to the applied signal. In accordance with the driving of the driving motor 101', the cam 110' axially coupled to the driving motor 101' and the lever 111 are rotated. As a result, the protrusion 112 formed at the end of the lever 111 moves the connecting member 120 backward while sliding along the slot 121 of the connecting member 120. Thus, the hood plate 51 is returned, as shown in FIG. 16.

When the cam 110' rotates about 180° (corresponding to the position B in FIG. 16) while continuously pressing the switch 102 (namely, maintaining the switch 102 in the ON state), in accordance with the driving of the driving motor 101', the pressing force applied to the switch 102 is released, so that the switch 102 changes the operation state thereof from the ON state to the OFF state. The resultant signal from the switch 102 is sent to the controller 132. Based on the signal from the switch 102, the controller 132 senses the fact that the hood plate 51 has moved to a maximum backward position, and stops the driving motor 101'. Thus, the hood plate 51 is maintained at a returned position corresponding to the maximum backward position.

In the wall-mounted microwave oven according to the fifth embodiment of the present invention, it is possible not only to achieve the separation and coupling of the hood plate in the same manner as the first embodiment, but also to automatically move the hood plate in forward and backward directions by the driving unit, which has a relatively simple structure. In addition, it is possible to achieve a reduction in costs, as compared to the fourth embodiment, because a motor rotatable in one direction is used in the fifth embodiment.

Figure 17:
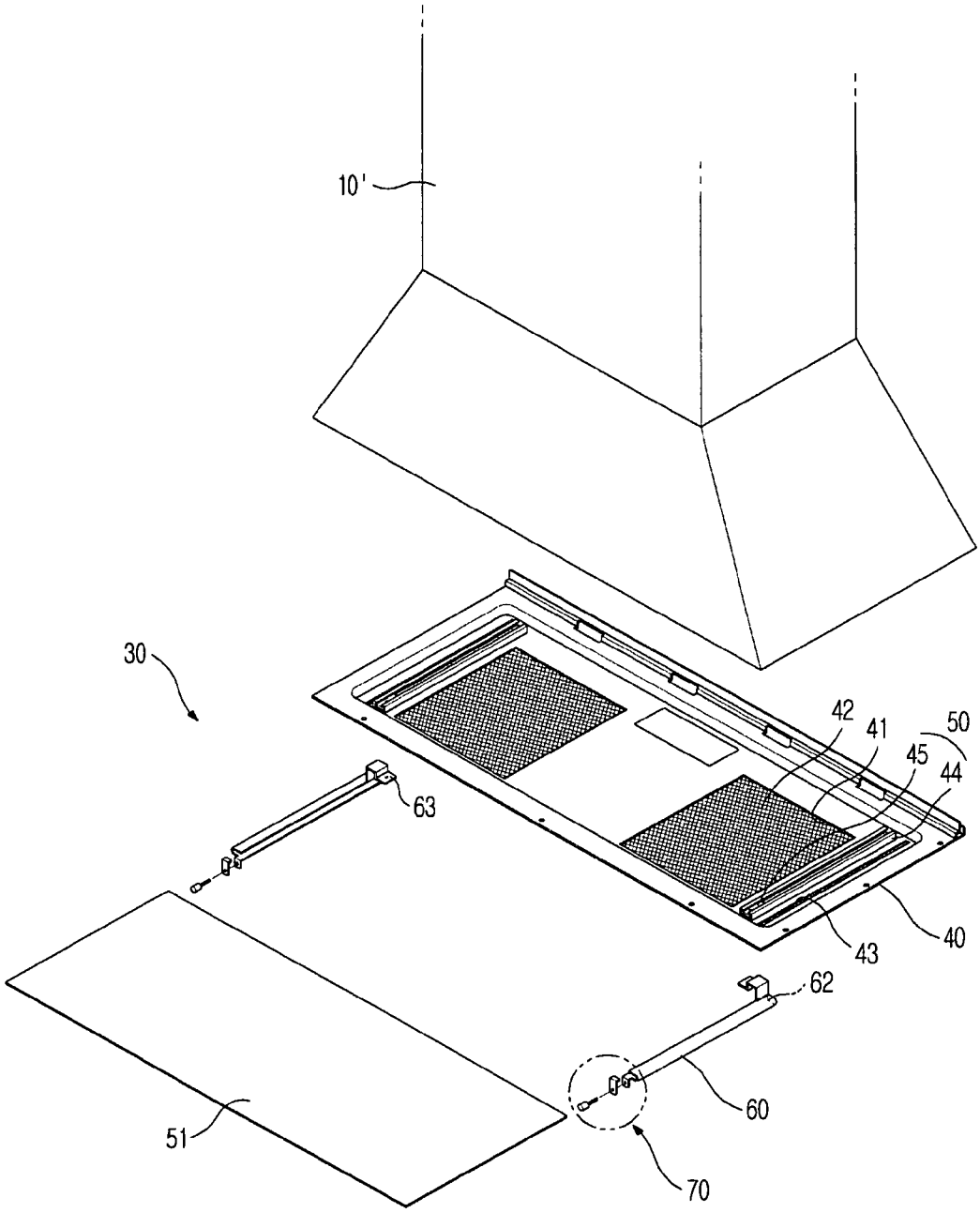
FIG. 17 is an exploded perspective view illustrating the case in which the embodiments of the present invention are implemented in a general hood appliance.

Although the hood mover of the present invention has been described in conjunction with the case in which the hood mover is applied to a wall-mounted microwave oven, all the technical configurations of the first to fifth embodiments of the present invention associated with the hood mover of the present invention can be applied to hood appliances having a hood function, other than wall-mounted microwave ovens. FIG. 17 illustrates the case in which the first embodiment of the present invention is applied to a hood appliance. The configuration of this case is identical to that of the first embodiment, except for a hood appliance 10'. Although a few embodiments of the present general inventive concept have been shown and described, it will be appreciated by those skilled in the art that changes may be made in these embodiments without departing from the principles and spirit of the invention, the scope of which is defined in the appended claims and their equivalents.

As apparent from the above description, where the wall-mounted microwave oven, which includes the hood mover according to the first or second embodiment of the present invention, is used, oil and dirt may be attached to the hood plate 51 and the coupling portions of the hood plate 51 and frame members 60 due to exhaust gas, fumes, etc. emitted from another cooking appliance arranged beneath the wall-mounted microwave oven. In this case, the user can separate the hood plate 51 from the frame members 60, using a simple method, and can easily clean the separated hood plate 51. After the cleaning, the user can couple the hood plate 51 to the frame members 60, using a simple method.

In particular, where the hood plate 51 is installed outside the lower case 40 of the body, as in the first embodiment, oil and dirt, which will be attached to the lower case 40, are attached to the hood plate 51 when the hood plate 51 is used without being forwardly drawn. In this case, accordingly, it is possible to use the lower case 40 of the body in a clean state, without causing the lower case 40 to be contaminated by oil and dirt.

When a separate exhaust passage is defined in the hood plate, which is separably coupled to the frame members, as in the third embodiment of the present invention, it is possible not only to easily clean the hood plate after separating the hood plate, but also to discharge exhaust gas, etc. sucked in a wider region to the outdoors because the suction of exhaust gas, etc. can be achieved not only through the lower case 40", but also through the hood plate 80, when the hood plate 80 is drawn forward. Even when the hood plate 80 is maintained in a retracted state, without being drawn forward, there is no degradation in exhaustion efficiency because the area of the inlets of the lower case 40" is not reduced.

Since it is also possible to implement a configuration capable of automatically moving the hood plate in forward and backward directions by a driving unit having a relatively simple structure, which uses a motor rotatable in normal and reverse directions or a motor rotatable in one direction, as in the fourth or fifth embodiment of the present invention, an enhancement in productivity and a reduction in costs can be achieved.

What is claimed is:

1. A wall-mounted microwave oven comprising:

a body comprising a lower case; and a hood mover movable with respect to the body, wherein the hood mover comprises a hood plate, a frame member to separably support the hood plate, and a moving member to move the frame member with respect to the body, the moving member comprises a fixed rail mounted to the body, and a moving rail movable with respect to the fixed rail, the frame member has an extension connected to the moving rail, the hood mover is arranged beneath or above the lower case, the extension extends from the frame member toward the moving rail, to be connected to the moving rail, and the lower case has a guide hole, through which the extension is movable.

2. The wall-mounted microwave oven according to claim 1, wherein the frame member has a channel-shaped guide groove to receive the hood plate, thereby enabling the frame member to support the hood plate, and a fastener to prevent a separation of the hood plate.

3. The wall-mounted microwave oven according to claim 2, wherein the frame member comprises a pair of linear frames each having one of the channel-shaped guide grooves and a stopper to prevent the hood plate from being excessively inserted into the respective guide groove.

4. The wall-mounted microwave oven according to claim 2, wherein the frame member comprises a 90°-rotated U-shaped frame having the channel-shaped guide groove.

5. The wall-mounted microwave oven according to claim 2, wherein the fastener comprises a fixed flange provided at a front end of the frame member, a separation preventing member arranged in front of the fixed flange, to prevent a separation of the hood plate, and a coupler to couple the separation preventing member to the fixed flange.

6. The wall-mounted microwave oven according to claim 2, wherein the fastener comprises a screw hole formed at one surface of the frame member, and a screw coupled to the screw hole.

7. The wall-mounted microwave oven according to claim 1, wherein the hood mover is arranged beneath the lower case, and the extension extends upwardly from the frame member.

8. The wall-mounted microwave oven according to claim 1, wherein the hood mover is arranged above the lower case, and the extension extends downwardly from the frame member.

* * * * *